US006200174B1

(12) United States Patent
Katoh et al.

(10) Patent No.: US 6,200,174 B1
(45) Date of Patent: Mar. 13, 2001

(54) CONNECTING TERMINAL

(75) Inventors: Mitsunobu Katoh; Hiroshi Watanabe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/457,590

(22) Filed: Dec. 9, 1999

(30) Foreign Application Priority Data

Jan. 14, 1999 (JP) ..... 11-008286
Jan. 14, 1999 (JP) ..... 11-008287

(51) Int. Cl.[7] ..... H01R 4/48
(52) U.S. Cl. ..... 439/862; 439/843; 439/852
(58) Field of Search ..... 439/862, 842, 439/843, 850, 851, 852, 858, 861, 839, 847

(56) References Cited

U.S. PATENT DOCUMENTS 5,413,495 * 5/1995 Takeuchi et al. ..... 439/852

FOREIGN PATENT DOCUMENTS 6-267606 9/1994 (JP) .
7-85918 3/1995 (JP) .

* cited by examiner

*Primary Examiner*—Paula Bradley
*Assistant Examiner*—Tho D. Ta
(74) *Attorney, Agent, or Firm*—Morgan, Lewis & Bockius LLP

(57) ABSTRACT

The present invention is for providing a connecting terminal enabling certain and easy connecting operation without losing durability. A connecting terminal of the invention comprises an electric wire caulking portion in the rear part and a plate spring-like elastic contact piece to be contacted with a counterpart conductor portion for electric connection, elongating from a front end fold back portion projecting from a terminal bottom plate in the front part, wherein the elastic contact piece and the front end fold back portion are provided continuously from a rising portion, linearly elongating from the front end of the terminal bottom plate forward and upward with a certain rising angle.

3 Claims, 9 Drawing Sheets

CONNECTING TERMINAL

BACKGROUND OF THE INVENTION

1. Field of the Invention

The present invention relates to a terminal structure of a connecting terminal to be used for connection in an electric system of an automobile. More specifically, it relates to a structure of the vicinity of a contact piece of a connecting terminal to be contacted with a substrate in an electric connection box so as to be conducted and connected.

2. Related Art

Conventionally, as the structure in the vicinity of a contact piece of a connecting terminal, various ones have been known. For example, a connecting terminal 31 shown in FIG. 9 is a female type connecting terminal comprising an electric wire caulking portion 32 and a core wire caulking portion 33 in the rear part, and a plate spring-like elastic contact piece 35 to be contacted with a counterpart conductor portion for electric connection, elongating from a front end fold back portion 34 projecting from a terminal bottom plate 36 in the front part. The elastic contact piece 35, in general, is covered with a top plate 38 supported by side plates 37 provided upright on the terminal bottom plate 36. By forcing and holding a counterpart conductor portion with the top plate 38, an electric connection state can be obtained.

In the connecting operation of the connecting terminal 31 with the above-mentioned configuration, a counterpart male type conductor portion is introduced from the front part, guided by the front end fold back portion 34 and the top plate 38 while forcing the elastic contact piece 35. At the time, the elastic contact piece 35 and the front end fold back portion 34 are deflected so as to hold the counterpart conductor portion with the top plate 38 for achieving the electric connection.

However, according to the conventional connecting terminal 31, when the counterpart male type conductor portion is introduced from the front part, guided by the front end fold back portion 34 and the top plate 38 while forcing the elastic contact piece 35, the elastic contact piece 35 and the front end fold back portion 34 are deflected, and finally the counterpart conductor portion is held with respect to the top plate 38. In this case, since the deflected portions are only the elastic contact piece 35 and the front end fold back portion 34, the distributed load value with respect to the deflection amount is relatively large. With the progress of the introduction of the counterpart conductor portion, the resistance force becomes larger and larger. Accordingly, a problem is involved in that the operativity in the connecting operation is deteriorated.

Further another example of conventional connecting terminal will be described. As the structure in the vicinity of a contact piece of a connecting terminal to be contacted with a substrate in an electric connection box for electric connection in an electric system of an automobile so as to be conducted and connected, various ones have been known. For example, a connecting terminal 131 shown in FIG. 10 is a contact piece exposed type connecting terminal comprising an electric wire caulking portion 132 and a core wire caulking portion 133 in the rear part, and a plate spring-like elastic contact piece 134 to be contacted with a counterpart conductor portion (not illustrated) for electric connection, elongating from a front end fold back portion 135 projecting from a terminal bottom plate 136 in the front part. Deflection preventing pieces 139 are provided below the elastic contact piece 34 by bending the upper end portion of both side plates 138 provided upright from both side ends of the terminal bottom plate 136.

The connecting terminal 131 can be stored in a predetermined connector housing so as to be contacted with a bus bar end portion or a predetermined position of a printing circuit on a substrate for obtaining an electric connection state. Accordingly, the elastic contact piece 134 is always in the state of elastically displaced toward the terminal bottom plate 136 side when it is contacted with a counterpart conductor portion.

In the connecting operation of the connecting terminal 131 with the above-mentioned configuration, a counterpart conductor portion guided by the front end fold back portion 135 and the connector housing (not illustrated) from the front side or from above while forcing the elastic contact piece 134 is surface-contacted. At the time, the elastic contact piece 134 and the front end fold back portion 135 are deflected so as to force the counterpart conductor portion for achieving the electric connection.

Then, in the case the elastic contact piece 134 is deflected excessively due to external force such as vibration in the state in which the counterpart conductor portion is contacted with the elastic contact piece 134, the lower surface of the elastic contact piece 134 comes in contact with the deflection preventing pieces 139 so that the excessive deflection is regulated.

However, since a specific portion comes in contact with the deflection preventing pieces 139 repeatedly in the conventional connecting terminal 131, a problem is involved in that the contacting portions are deteriorated or flawed so as to ruin a good connection state.

Moreover, since the elastic contact piece 134 comes in contact with the deflection preventing pieces 139 vigorously so as to be plastically deformed if an external force larger than the tolerable limit is applied, a problem is involved in that a good connection state with the counterpart conductor portion cannot be ensured.

SUMMARY OF THE INVENTION

In order to solve the above-mentioned problem, an object of the invention is to provide a connecting terminal enabling certain and easy connecting operation without losing durability.

Another object of the invention is to provide a connecting terminal having excellent durability and reliability without the risk of flaw or deformation of an elastic contact piece by an excessive external force.

The above-mentioned problem can be solved by a connecting terminal according to the invention comprising an electric wire caulking portion in the rear part and a plate spring-like elastic contact piece to be contacted with a counterpart conductor portion for electric connection, elongating from a front end fold back portion projecting from a terminal bottom plate in the front part, wherein the elastic contact piece and the front end fold back portion are provided continuously from a rising portion, linearly elongating from the front end of the terminal bottom plate forward and upward with a certain rising angle.

The above-mentioned problem can be solved by a connecting terminal according to the invention comprising an electric wire caulking portion in the rear part and a plate spring-like elastic contact piece to be contacted with a counterpart conductor portion for electric connection, elongating from a front end fold back portion projecting from a terminal bottom plate in the front part, wherein deflection regulating walls are provided upright outside the elastic contact piece from both side ends of the terminal bottom plate such that excessive displacement of the elastic contact piece is prevented by the contact of the upper end portion of the deflection regulating walls with the counterpart conductor portion or a substrate holding the conductor portion in the case the elastic contact piece is displaced between the deflection regulating walls by more than a set value.

According to the connecting terminal with the configuration, since the elastic contact piece and the front end fold back portion are provided continuously from the rising portion, linearly elongating from the front end of the terminal bottom plate forward and upward with a certain rising angle, in addition to the elastic contact piece and the front end fold back portion, the rising portion is deflected as well by the contact of the counterpart conductor portion. Therefore, the distributed load with respect to the deflection amount becomes smaller without the risk of having the resistance force according to the contact of the counterpart conductor portion drastically enlarged so that the connecting operation can be executed with a substantially constant pressure, and thus the operativity can be improved.

According to the connecting terminal with the configuration, since deflection regulating walls are provided upright outside the elastic contact piece from both side ends of the terminal bottom plate, excessive displacement of the elastic contact piece is prevented by the contact of the upper end portion of the deflection regulating walls with the counterpart conductor portion or a substrate holding the conductor portion in the case the elastic contact piece is displaced between the deflection regulating walls by more than a set value. That is, even in the case an excessive external force is applied on the elastic contact piece, it cannot come in contact with the deflection regulating walls. In the case the elastic contact piece is displaced by more than a set value, the deflection regulating walls come in contact with the counterpart conductor portion or the substrate surface so as to regulate the excessive deflection of the elastic contact piece.

Therefore, the elastic contact piece cannot be flawed or deformed by an excessive external force, and thus a connecting terminal having excellent durability and reliability can be obtained.

DETAILED DESCRIPTION OF THE PREFERRED EMBODIMENT

Figure 1:
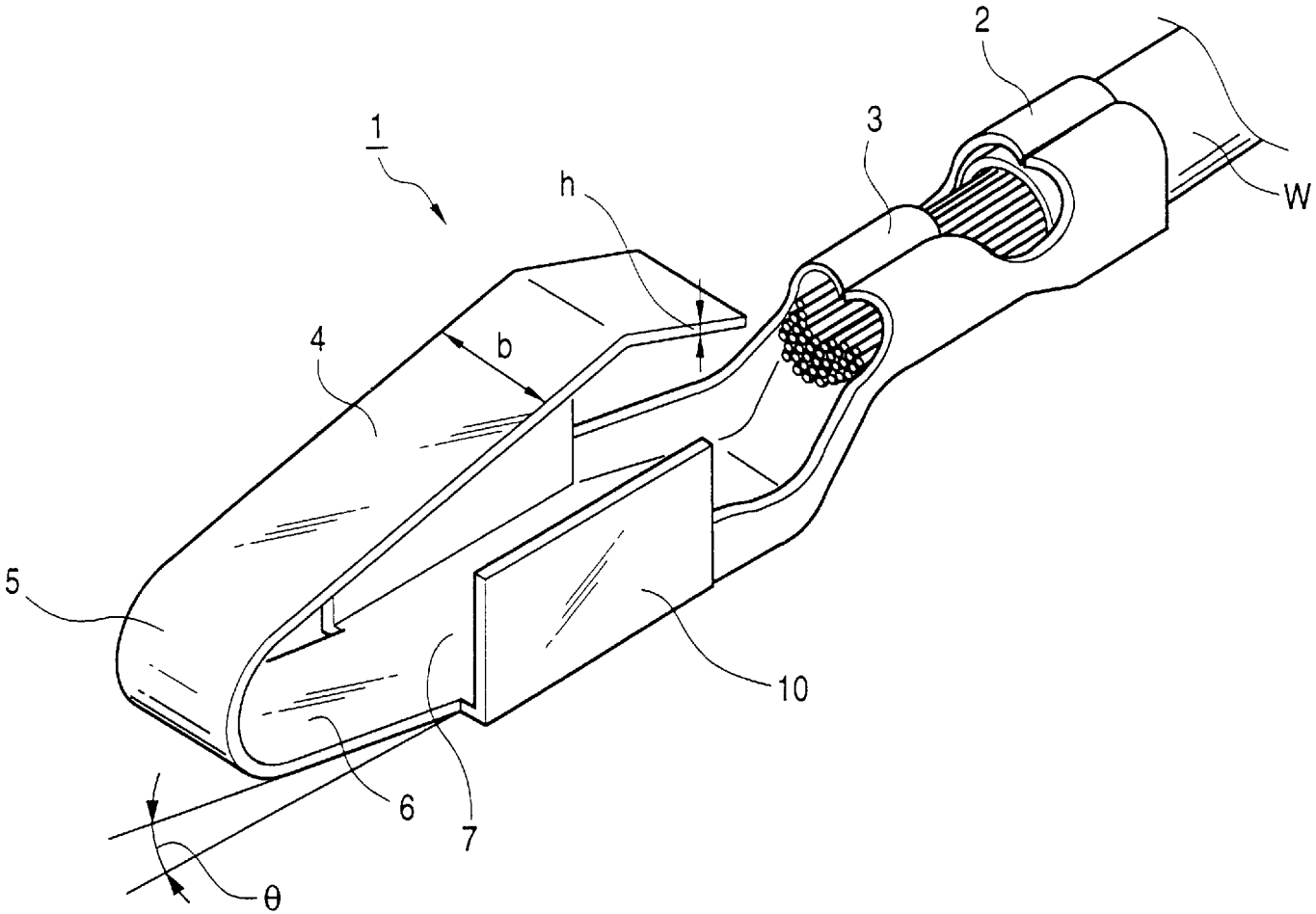
FIG. 1 is a perspective view showing an embodiment of a connecting terminal according to the invention.
Figure 2:
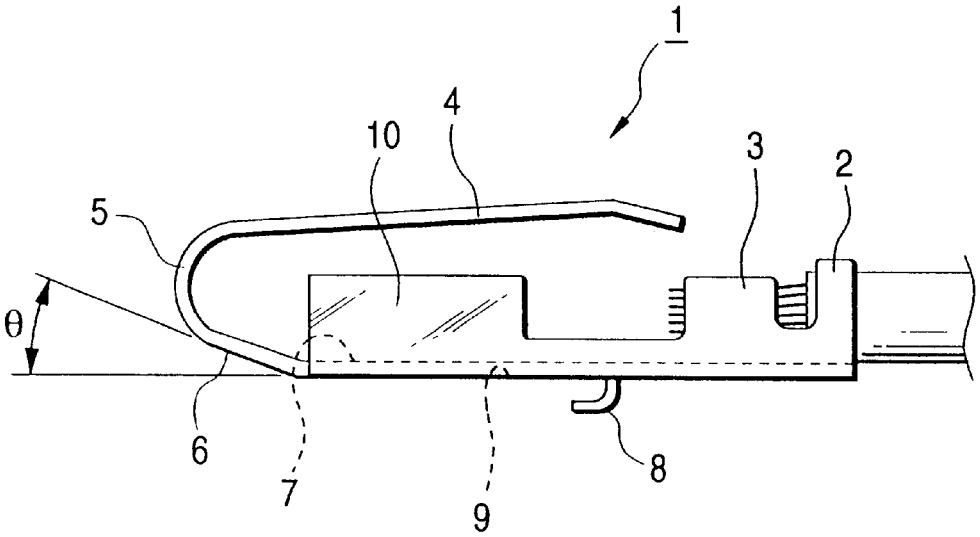
FIG. 2 is a side view of FIG. 1.

As shown in FIGS. 1 and 2, a connecting terminal 1 according to the embodiment is a contact piece exposed type connecting terminal to be stored in a connector housing for contacting with a bus bar end portion or a predetermined position of a printing circuit on a substrate so as to obtain an electric connection state. The connecting terminal 1 comprises an electric wire caulking portion 2 and a core wire caulking portion 3 in the rear part, and a rising portion 6 formed linearly elongating from the front end of a terminal bottom plate 7 obliquely upward to the front side with a certain rising angle θ in the front part. An R-like front end fold back portion 5 is provided continuously from the rising portion 6, projecting to the front end. A plate spring-like elastic contact piece 4 is provided continuously from the front end fold back portion 5 elongating obliquely upward to the rear side for forcing a counterpart conductor portion. By the contact of the elastic contact piece 4 and the counterpart conductor portion, electric connection can be provided.

Figure 6:
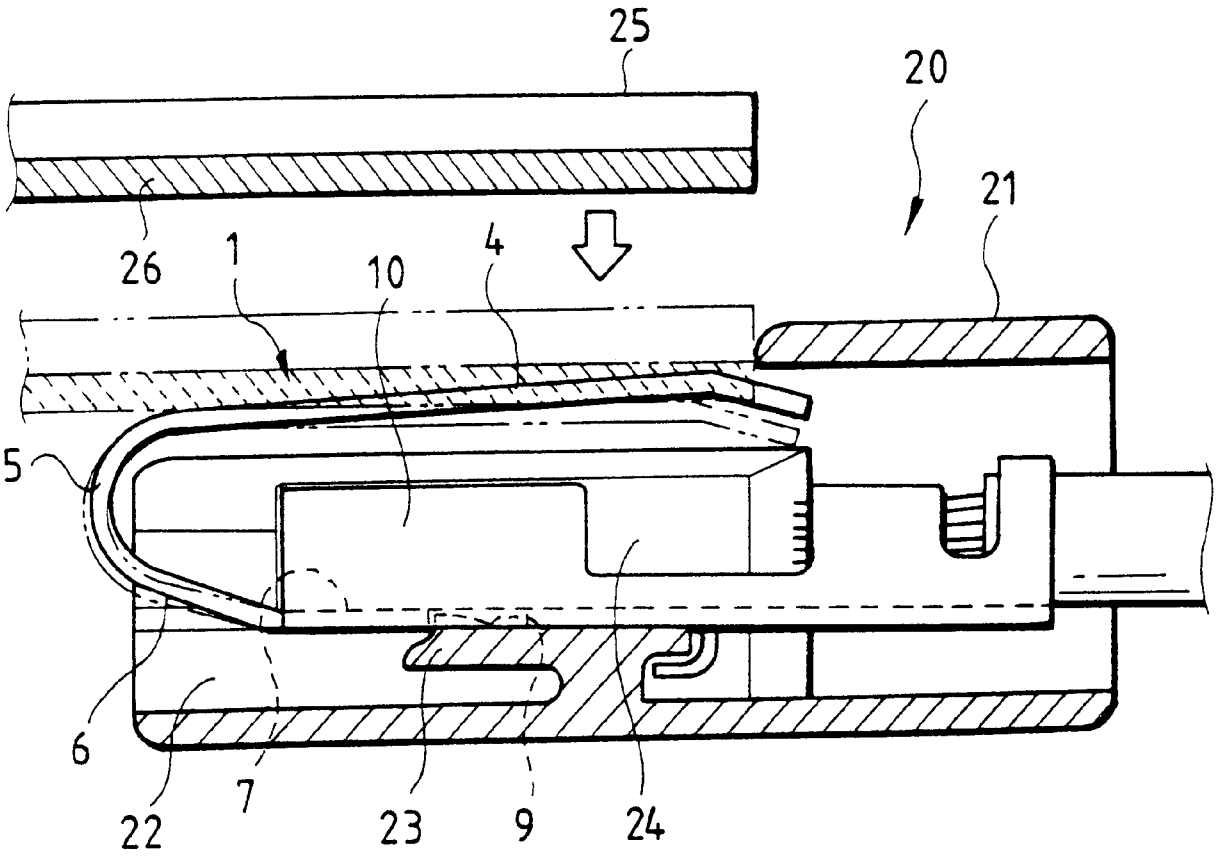
FIG. 6 is a cross-sectional view taken on the line E—E in FIG. 5, showing the relationship with a counterpart substrate.

Furthermore, a pair of deflection regulating walls 10, 10 are provided upright outside the elastic contact piece 4 from both side ends of the terminal bottom plate 7. That is, as shown in FIG. 6, the width size d between the deflection regulating walls 10, 10, facing with each other with the elastic contact piece 4 therebetween, is set to be larger than the width size b of the elastic contact piece 4.

The deflection regulating walls 10 are for preventing excessive displacement of the elastic contact piece 4 when an external force for displacing the elastic contact piece 4 by more than a set value is applied. That is, the displacement of the elastic contact piece 4 can be regulated by the contact of the upper end portion of the deflection regulating walls 10 with the counterpart conductor portion 26 or a substrate 25 holding the conductor portion in the case an excessive external force is applied.

Figure 3:
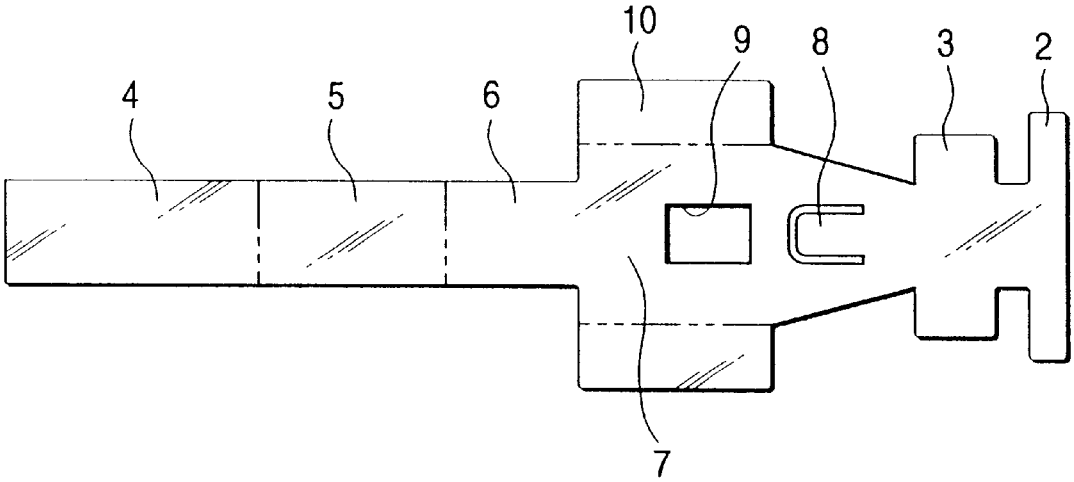
FIG. 3 is an developed view of FIG. 1.

Moreover, in the developed view of the connecting terminal shown in FIG. 3, a portion surrounded by a U-shaped punching hole is a terminal lance 8 to be engaged with a connector housing (not illustrated). A square hole 9 is to be engaged with a housing lance of the connector housing. The electric wire caulking portion 2 for pressing a covered portion of an electric wire end portion and the core wire caulking portion 3 for pressing a core wire portion are provided on the right end of the figure. Deflection regulating walls 10 for restraining the deflection amount of the elastic contact piece 4 are provided on both sides of the center part of the figure. Furthermore, the above-mentioned elastic contact piece 4, front end fold back portion 5 and rising portion 6 are provided continuously like a band on the left end of the figure. By folding at the imaginary lines in the figure optionally, the device can be produced as shown in FIG. 1.

The theoretical support of the connecting terminal with the above-mentioned configuration will be explained with reference to FIG. 4. With the premise that the deflection amount between the points A and B is $\delta 1$, the deflection amount at the front end fold back potion 5 between the points B and C is $\delta 2$, and the deflection amount at the rising portion 6 between the points C and D is $\delta 3$ in the case a distributed load $\omega$ is applied on the elastic contact piece 4, the total deflection amount $\delta=\delta 1+\delta 2+\delta 3$.

Therefore, since the spring constant $K=\omega/\delta$, $K=\omega/(\delta 1+\delta 2+\delta 3)$. Accordingly, by providing the rising portion 6, the spring constant K becomes smaller so that the spring can be more flexible without reducing the plate thickness h as well as the repulsion can be maintained substantially constantly even in the case the deflection amount is increased.

The operation of the connecting terminal with the above-mentioned configuration will be explained with reference to FIGS. 5–6, 7A and 8A. In this embodiment, the connecting operation with respect to the counterpart conductor portion 26 formed on the substrate 25 will be described. The case with the width size c of the counterpart conductor portion 26 narrower than the width size d between the deflection regulating walls 10, 10 larger than the width size b of the elastic contact piece 4 will be explained.

Figure 4:
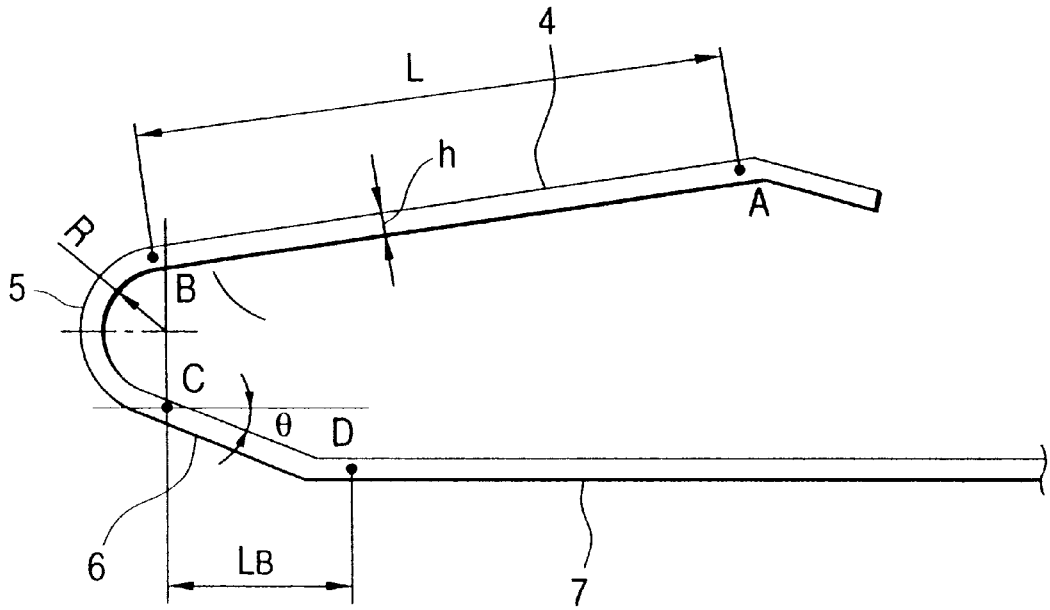
FIG. 4 is a diagram for explaining the principle of deflected portions of FIG. 1.
Figure 5:
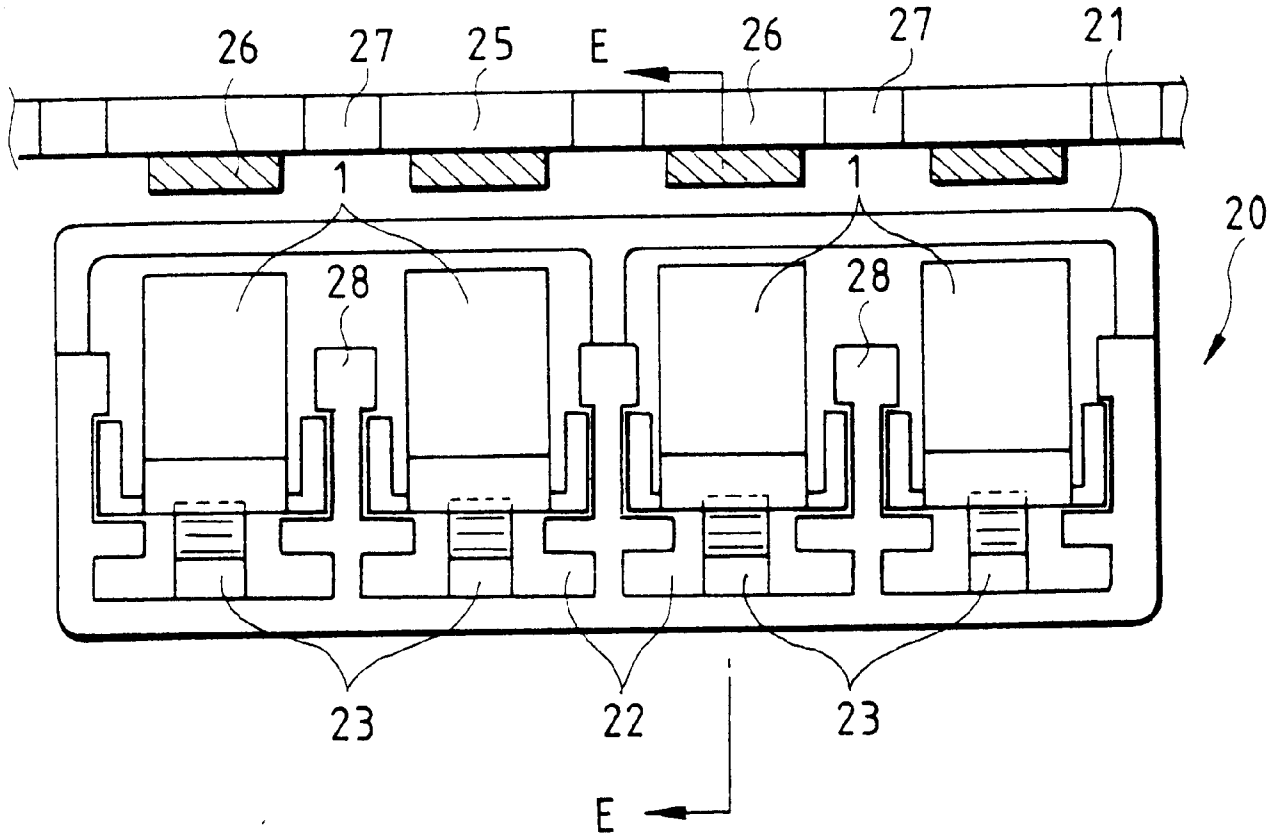
FIG. 5 is a plan view showing the storage state of the connecting terminal of FIG. 1 in a connector housing.

As shown in FIGS. 4 and 5, the above-mentioned connecting terminal 1 formed in a connector housing 21 of a connector 20 is stored in a terminal storage room 22 with the substantially half or more of one side (upper part in the figure) opened.

At the time, the square hole 9 of the terminal bottom plate 7 and a housing lance 23 provided upright on the bottom wall of the terminal storage room 22 are engaged as well as the deflection regulating walls 10 are engaged while being guided by engaging grooves 24 formed on both partition walls 28 comprising the terminal storage room 22. In this state, the elastic contact piece 4 of the connecting terminal 1 is exposed completely to the upper side in the figure.

Moreover, the substrate 25 comprising the conductor portion 26 comprising a predetermined circuit, and through holes 27 for avoiding contact with the partition walls 28 at the time of connecting with the connector housing 21 is fixed to an appliance main body (not illustrated).

As shown in FIGS. 5–6, 7A and 8A, in the state that the connecting terminal 1 is stored completely in the connector housing 21, the conductor portion 26 on a substrate 25 fixed at a predetermined position of an appliance (not illustrated) is contacted with the connecting portion on the connector housing 21 with the elastic contact piece 4 exposed. At the time, since in addition to the elastic contact piece 4 and the front end fold back portion 5, the rising portion 6 is deflected as well according to the pressure of the conductor portion 26, the connecting operation can be executed certainly with a substantially constant pressure without the risk of having the connecting force drastically enlarged.

Figure 7A:
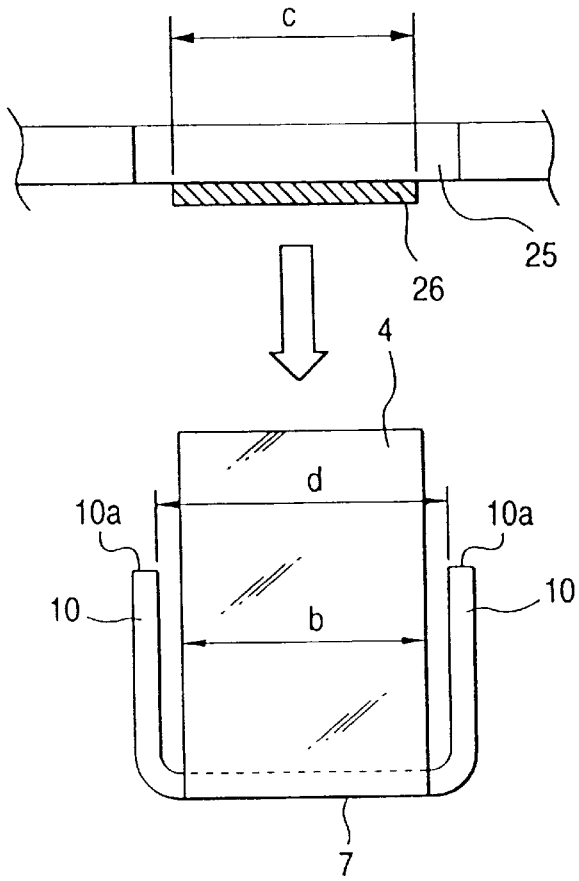
FIG. 7A and FIG. 7B are schematic diagrams excluding the connector housing of FIG. 5 for explaining the positional relationship with respect to the counterpart conductor portion.

That is, as shown in FIG. 7A, if the counterpart conductor portion 26 on the substrate 25 contacts with the elastic contact piece 4 with an optional pressure, the elastic contact piece 4 is deflected to the terminal bottom plate 7 direction. According to the deflection, a force is generated in the elastic contact piece 4 with respect to the counterpart conductor portion 26. Accordingly, the elastic contact piece 4 can contact with the counterpart conductor portion 26 with an optional contact pressure so as to be in an electric connection state.

Figure 8A:
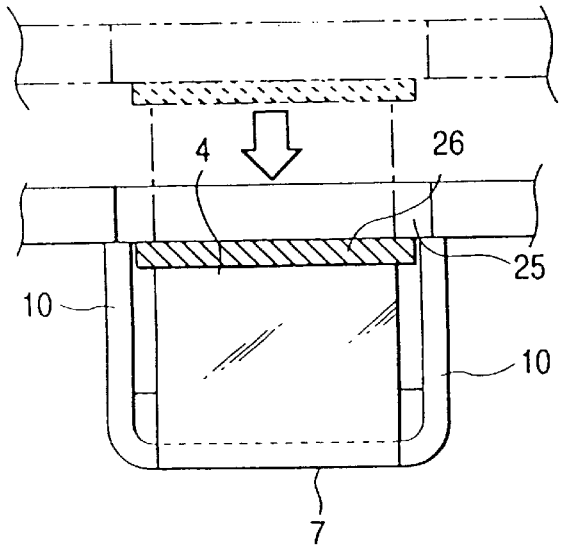
FIG. 8A and FIG. 8B are schematic diagrams for explaining the contact state of the deflection regulating walls and the substrate surface of FIG. 6.

However, as shown in FIG. 8A, in the case the elastic contact piece 4 is displaced between the deflection regulating walls 10, 10 by more than a set value, the upper end portion 10*a* of the deflection regulating walls 10 comes in contact with the substrate 25 holding the conductor portion 26. Accordingly, excessive deflection of the elastic contact piece 4 can be prevented without contacting with the deflection regulating walls 10. Therefore, even in the case an excessive external force is applied on the elastic contact piece 4, the good connection state with the counterpart conductor portion 26 can be maintained as well as flaw or plastic deformation of the elastic contact piece 4 itself can be prevented. The connector housing 21 is fixed to the appliance main body (not illustrated) to which the substrate 25 is fixed when the connecting operation is completed.

As mentioned above, since a pair of the deflection regulating walls 10, 10 are provided upright outside the elastic contact piece 4 from both side ends of the terminal bottom plate 7 in the connecting terminal 1 according to this embodiment, in the case the elastic contact piece 4 is displaced between the deflection regulating walls 10 by more than a set value, the upper end portion of the deflection regulating walls 10 comes in contact with the substrate 25 holding the counterpart conductor portion 26.

The invention is not limited to the above-mentioned embodiment, but can be provided in other forms with an optional modification. For example, although the deflection regulating walls 10 are substantially rectangular side walls having corner portions in this embodiment, by adopting a configuration with a smaller contacting portion with the substrate 25, the influence on the substrate and the counterpart conductor portion 26 can be minimized. For example, the deflection regulating walls 10 can be provided with an arc-like upper end portion instead of the rectangular shape or the upper end portion of the rectangular deflection regulating walls 10 can be bent outward with an R-like shape. Moreover, in the case the width size between the deflection regulating walls 10, 10 is larger than the width size of the elastic contact piece 4, the deflection regulating walls 10 can be bent inward within the range not interfering with the displaced elastic contact piece 4.

As mentioned above, according to the connecting terminal 1 of the embodiment, since the elastic contact piece 4 and the front end fold back portion 5 are provided continuously from the rising portion 6, linearly elongating from the front end of the terminal bottom plate 7 forward and upward with a certain rising angle θ, in addition to the elastic contact piece 4 and the front end fold back portion 5, the rising portion 6 is deflected as well by the contact of the counterpart conductor portion.

Therefore, the distributed load value with respect to the deflection amount becomes smaller without the risk of having the connection force according to the contact of the counterpart conductor portion drastically enlarged so that the connecting operation can be executed certainly and easily with a substantially constant pressure.

Figure 9:
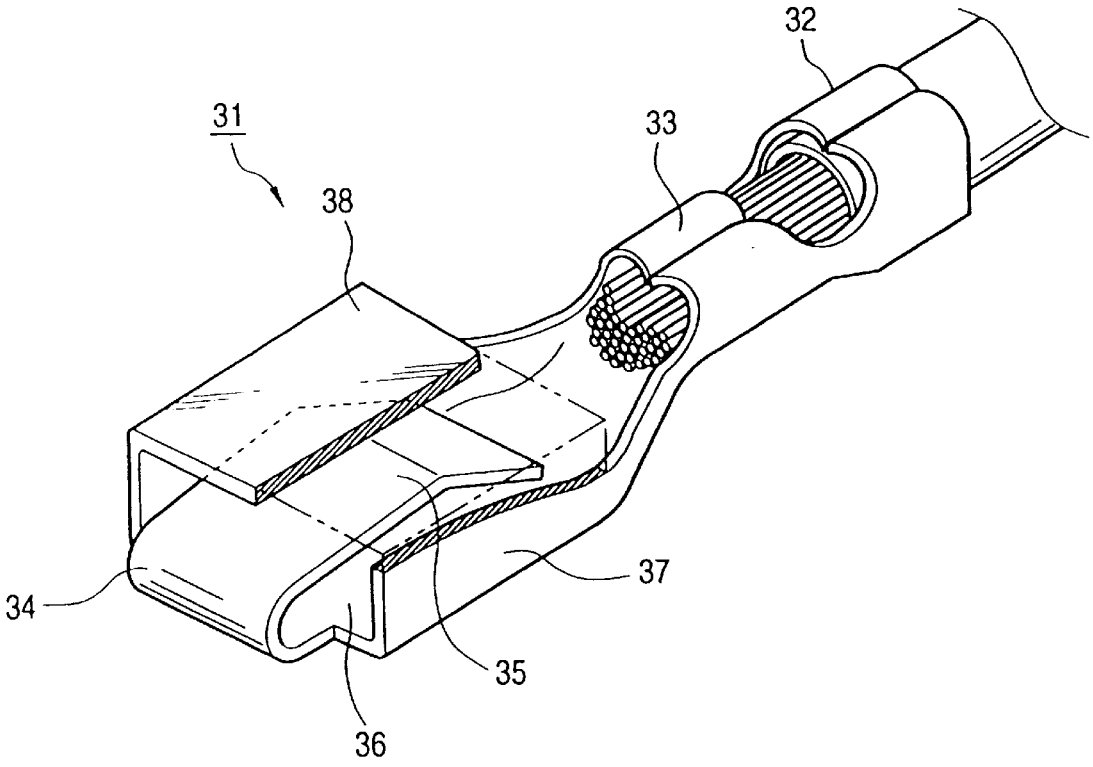
FIG. 9 PRIOR ART
FIG. 9 is a perspective view showing an example of a conventional connecting terminal.
Figure 10:
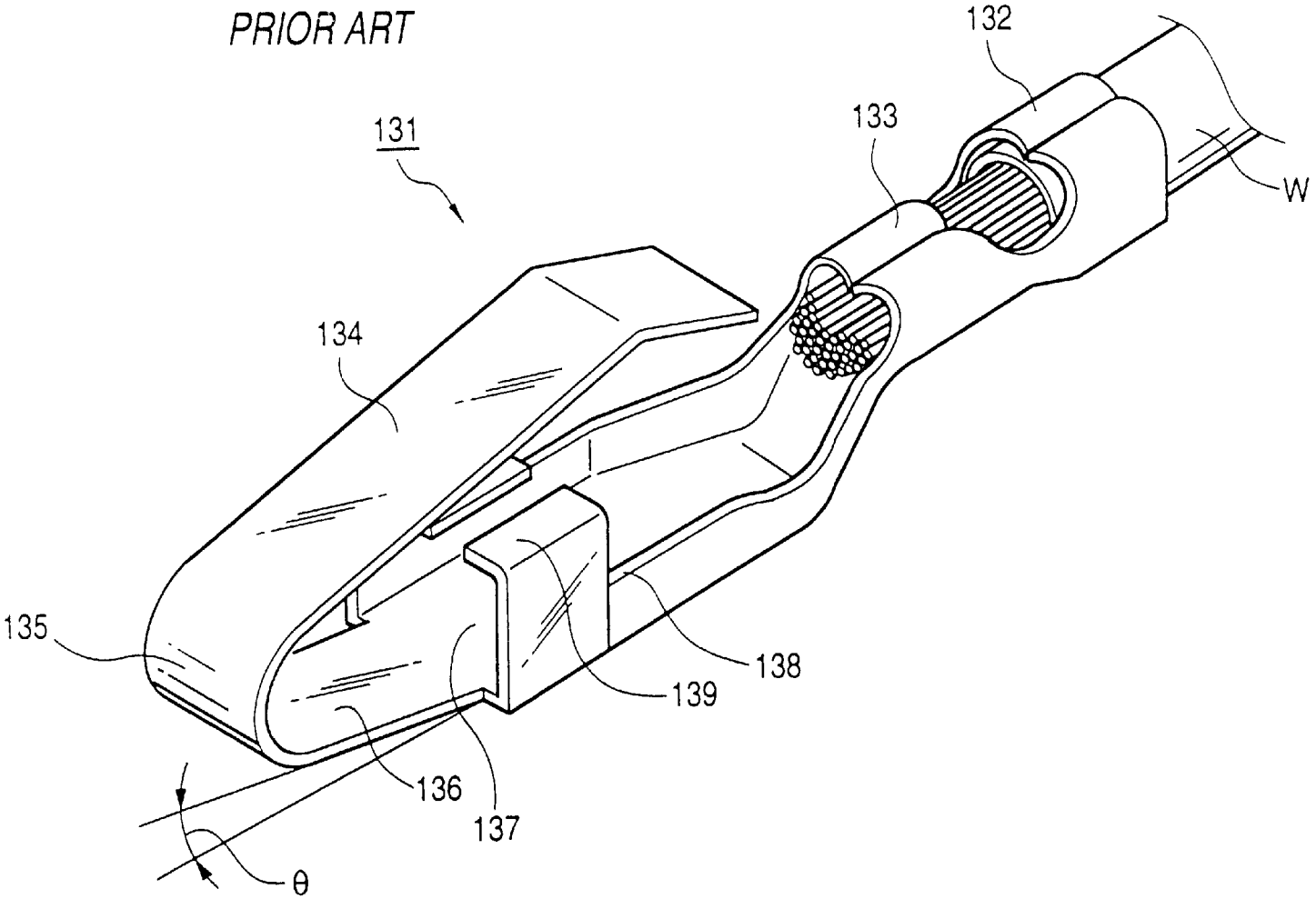
FIG. 10 PRIOR ART
FIG. 10 is a perspective view showing an example of another conventional connecting terminal.

The invention is not limited to the above-mentioned embodiment, but can be provided in other forms with an optional modification. For example, although the base of the rising portion 6 is at the front end of the terminal bottom plate 7 in this embodiment, it can be provided at the front end of a top plate of a box type terminal as shown in FIG. 9.

Figure 7B:
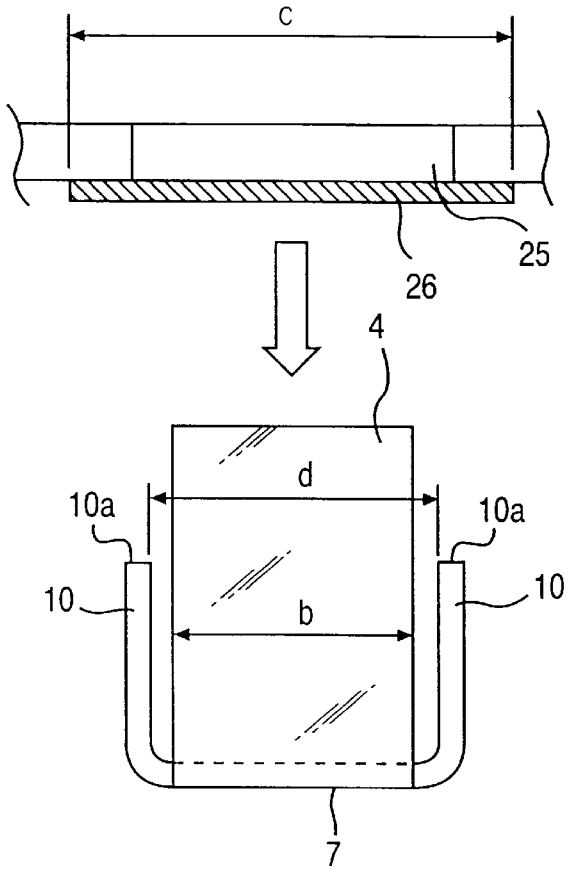
Figure 8B:
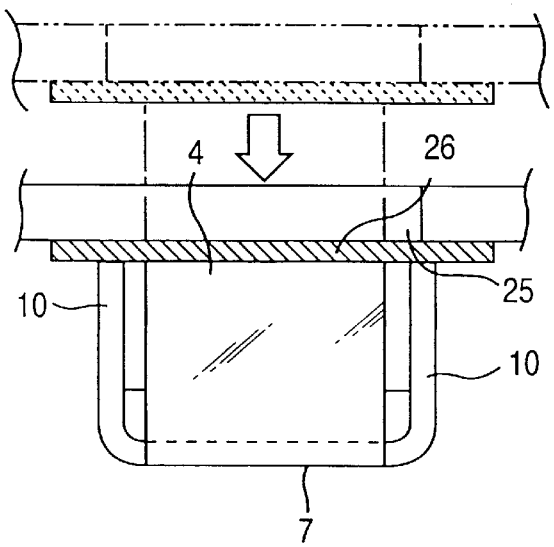

As another example of optional modification, FIGS. 7B and 8B illustrate the embodiment where a counterpart conductor is wider than the width size of the deflection regulating walls. Like or similar parts are identified throughout by the same reference characters. The counterpart conductor 26 width c can be made wider than dimension d, as shown in FIG. 7A. When brought into contact the upper end portion 10*a* of the deflection walls, as shown in FIG. 8B, the same advantages as those described with respect to FIGS. 7A and 8A are achieved.

As heretofore mentioned, according to a connecting terminal of the invention, since an elastic contact piece and a front end fold back portion are provided continuously from a rising portion, linearly elongating from the front end of a terminal bottom plate forward and upward with a certain rising angle, in addition to the elastic contact piece and the front end fold back portion, the rising portion is deflected as well by the contact of a counterpart conductor portion.

Therefore, the distributed load value with respect to the deflection amount becomes smaller so that a substantially constant pressure can be provided without the risk of having the connection force according to the contact of the counterpart conductor portion drastically enlarged. Accordingly, the connecting operation can be executed certainly and easily and thus the operativity can be improved.

As heretofore mentioned, according to a connecting terminal of the invention, deflection regulating walls are provided upright outside the elastic contact piece from both side ends of the terminal bottom plate such that excessive displacement of the elastic contact piece is prevented by the contact of the upper end portion of the deflection regulating walls with the counterpart conductor portion or a substrate holding the conductor portion in the case the elastic contact piece is displaced between the deflection regulating walls by more than a set value.

That is, even in the case an excessive external force is applied on the elastic contact piece, it cannot come in contact with the deflection regulating walls, but since the deflection regulating walls come in contact with the counterpart conductor portion or the substrate surface so as to regulate the excessive deflection of the elastic contact piece, the elastic contact piece cannot be flawed or deformed by the excessive external force. Therefore, a connecting terminal having excellent durability and reliability can be obtained.

What is claimed is:

1. A connecting terminal comprising:

a front part and a rear part;

an electric wire press-fitting portion provided in the rear part;

a plate spring-like elastic contact piece to be contacted with a mating conductor portion for electric connection, said plate spring-like elastic contact piece elongated from a front end fold back portion projecting from a terminal bottom plate in the front part; and a rising portion from which the elastic contact piece and the front end fold back portion are continuously provided, said rising portion linearly elongated from the front end of the terminal bottom plate forward and upward with a certain rising angle.

2. A connecting terminal comprising:

a front part and a rear part;

an electric wire press-fitting portion provided in the rear part;

a plate spring-like elastic contact piece to be contacted with a mating counterpart conductor portion for electric connection, said plate spring-like elastic contact piece elongated from a front end fold back portion projecting from a terminal bottom plate in the front part;

deflection regulating walls provided upright outside the elastic contact piece from both side ends of the terminal bottom plate such that excessive displacement of the elastic contact piece is prevented by the contact of the upper end portion of the deflection regulating walls with the counterpart conductor portion or a substrate holding the counterpart conductor portion in the case where the elastic contact piece is displaced between the deflection regulating walls by more than a predetermined value.

3. A connecting terminal comprising:

a front part and a rear part;

an electric wire press-fitting portion provided in the rear part;

a plate spring-like elastic contact piece to be contacted with a mating counterpart conductor portion for electric connection, said plate spring-like elastic contact piece elongated from a front end fold back portion projecting from a terminal bottom plate in the front part;

a rising portion from which the elastic contact piece and the front end fold back portion are continuously provided, said rising portion linearly elongated from the front end of the terminal bottom plate forward and upward with a certain rising angle; and deflection regulating walls provided upright outside the elastic contact piece from both side ends of the terminal bottom plate such that excessive displacement of the elastic contact piece is prevented by the contact of the upper end portion of the deflection regulating walls with the counterpart conductor portion or a substrate holding the counterpart conductor portion in the case where the elastic contact piece is displaced between the deflection regulating walls by more than a predetermined value.

* * * * *